US005135818A

United States Patent [19]

Shimada et al.

[11] Patent Number: 5,135,818

[45] Date of Patent: Aug. 4, 1992

[54] THIN SOFT MAGNETIC FILM AND METHOD OF MANUFACTURING THE SAME

[75] Inventors: Yutaka Shimada; Akihiko Hosono, both of Sendai; Hideo Fujiwara, Ibaraki, all of Japan

[73] Assignee: Hitachi Maxell, Ltd., Osaka, Japan

[21] Appl. No.: 498,415

[22] Filed: Mar. 26, 1990

[30] Foreign Application Priority Data

Mar. 28, 1989 [JP] Japan ..... 1-074075

[51] Int. Cl.[5] ..... H01F 10/12

[52] U.S. Cl. ..... 428/693; 148/307; 148/308; 360/125; 360/127; 427/128; 427/130; 427/132; 428/457; 428/469; 428/681; 428/692

[58] Field of Search ..... 428/692, 693, 611, 678, 428/681, 457, 469; 360/125, 127; 427/128, 130, 132; 148/307, 308

[56] References Cited

U.S. PATENT DOCUMENTS

| | | | |
|---|---|---|---|
| 2,992,951 | 7/1961 | Aspden | 148/308 |
| 3,095,324 | 6/1963 | Cusano et al. | 428/692 |
| 3,130,092 | 4/1964 | Kehler et al. | 148/308 |
| 3,837,911 | 9/1974 | Bobeck et al. | 427/127 |
| 4,001,793 | 1/1977 | Henry et al. | 428/693 |
| 4,025,379 | 5/1977 | Whetstone | 428/692 |
| 4,434,212 | 2/1984 | Robertson et al. | 428/693 |
| 4,439,794 | 3/1984 | Shiroishi et al. | 360/127 |
| 4,450,494 | 5/1984 | Fujiwara et al. | 360/125 |
| 4,499,155 | 2/1985 | Holiday et al. | 428/611 |
| 4,610,932 | 9/1986 | Haynes et al. | 428/611 |
| 4,626,947 | 12/1986 | Narishige et al. | 360/125 |
| 4,750,072 | 6/1988 | Takagi | 360/125 |
| 4,918,555 | 4/1990 | Yoshizawa et al. | 360/125 |

FOREIGN PATENT DOCUMENTS

| | | |
|---|---|---|
| 0182511 | 7/1985 | Japan . |
| 61-211818 | 9/1986 | Japan . |
| 0274607 | 11/1987 | Japan . |
| 360055 | 3/1990 | Japan . |

OTHER PUBLICATIONS

European Search Report with Annex.

*Primary Examiner*—Ellis P. Robinson
*Assistant Examiner*—Archene A. Turner
*Attorney, Agent, or Firm*—Birch, Stewart, Kolasch & Birch

[57] ABSTRACT

Disclosed is a soft magnetic film comprising a thin film of magnetic material of cubic symmetry, characterized in that crystal face (111) of the thin film is oriented substantially parallel to the surface of the thin film.

6 Claims, 2 Drawing Sheets

ZnSe (CUBIC ZINC SULFIDE STRUCTURE)
fcc a = 5.65
Fe bcc a = 2.83

ZnSe (CUBIC ZINC SULFIDE STRUCTURE)
fcc a = 5.65
Fe bcc a = 2.83

THIN SOFT MAGNETIC FILM AND METHOD OF MANUFACTURING THE SAME

BACKGROUND OF THE INVENTION

1. Field of the Invention

The present invention relates to a thin soft magnetic film used, for example, in a magnetic head, and more specifically, to a thin soft magnetic film having a crystal face of a magnetic material of a cubic system oriented to a particular direction and a method of manufacturing the same.

2. Discussion of Related Art

In general, a method of making a magnetostriction constant small can be employed as one of the conditions for forming a thin soft magnetic film. A magnetostriction constant is usually determined depending on kinds of magnetic substances. In the case of alloy, the magnetostriction constant thereof can be made to a very small value by selecting a composition of the alloy, but in many cases, since magnetic substances are composed of crystals and the magnetostriction constant thereof has different values depending on the crystallographic directions, it is impossible to make the magnetostriction constant zero in all the directions.

Polycrystals are often used as a soft magnetic material, and in this case the effect of magnetostriction is avoided in such a manner that an average value of magnetostriction constants in respective directions is caused to approach zero. This is also applicable to a polycrystal thin film. However, it is difficult to perfectly remove the effect that a partial magnetostriction suppresses magnetization rotation.

SUMMARY OF THE INVENTION

It is an object of the present invention to overcome the above drawback and to provide a thin soft magnetic film not adversely affected by magnetostriction and a method of manufacturing the same.

To achieve the above-mentioned object, the present invention is characterized in that a thin film composed of a magnetic material of cubic system, such as Fe-Si alloy, is formed on an underlayer composed, for example, of a Zn-Se alloy, the crystal face (111) of the thin film being oriented substantially parallel to the surface of the thin film.

To achieve the above-mentioned object, the present invention is further characterized in that a thin film composed of a magnetic material of a cubic system, such as Fe-Si alloy or the like, is formed on a deposited surface composed, for example, of Zn-Se alloy, and heated to 300° C. or higher whereby the crystal face (111) of the thin film is oriented substantially parallel to the surface of the thin film.

DETAILED DESCRIPTION OF THE PREFERRED EMBODIMENT

Figure 1:
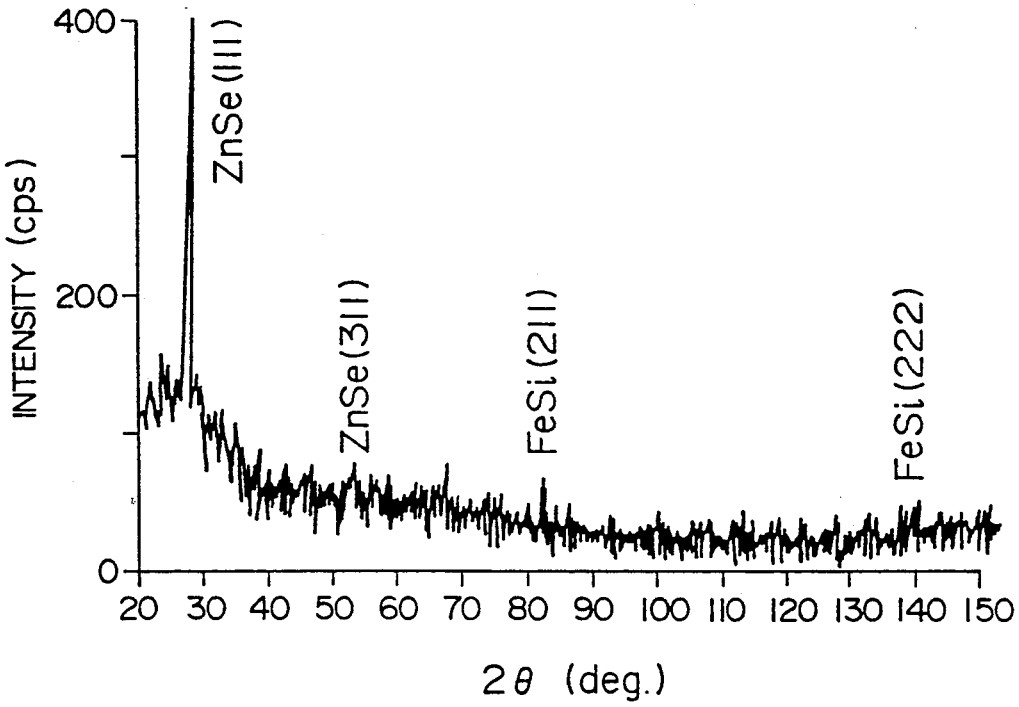
FIG. 1 is a diagram of an X-ray diffraction pattern of a Fe-Si thin soft magnetic film formed on a Zn-Se underlayer.

As described above, when a thin film composed of a magnetic material of a cubic system is formed and the crystal face (111) thereof is oriented substantially parallel to the surface of the thin film, a so-called isotropic magnetostriction is exhibited wherein magnetostriction does not depend on the magnetization directions in the plane. Therefore, a thin soft magnetic film of high magnetic permeability can be obtained wherein magnetization is directed to the film face except at the portion of a magnetic wall unless vertical magnetic anisotropy liable to direct to a vertical direction with respect to the film face is not especially given, no distortion is produced in the grain boundaries, if any, as in the case of polycrystalline films, due to the magnetostriction difference between the crystallites which will otherwise exist, and thus no adverse effect by magnetostriction exists.

Further, if the value of $(\lambda_{100}+2\lambda_{111})$, where $\lambda_{100}$ and $\lambda_{111}$ stand for the magnetostriction coefficients in <100> and <111> directions, respectively, is small, and then the following equation is established, $$|\lambda_{100}+2\lambda_{111}|<2/3\,\{|\lambda_{100}|+2|\lambda_{111}|\}$$

more preferably, $$|\lambda_{100}+2\lambda_{111}|<\tfrac{1}{3}\{|\lambda_{100}|+2|\lambda_{111}|\},$$

or in other words, if the composition of the film is selected so as to make the saturation magnetostriction coefficient negligible, a thin soft magnetic film which is not affected at all by magnetostriction can be obtained.

The present invention will be described below with reference to an embodiment in which iron is used. The present invention, however, is not limited to iron, but, for example, Ni, Ni-Fe alloy, or ferrite having a spinel structure such as Mn-Zn ferrite and Ni-Zn ferrite, and the like can be used. In this case, however, it is needed that an environment in which an underlayer corresponding to a magnetic material of cubic system, or the like is provided so that crystal face (111) of the magnetic material of the cubic system is oriented substantially parallel to the surface of the thin film.

Although a thin film was formed using sputtering in the following examples, vapor deposition and the like are also applicable.

A thin soft magnetic film obtained by the present invention can be used as various magnetic materials, such as, for example, a magnetic head, a high frequency transformer, and the like.

EMBODIMENT

A magnetic material of a cubic system used in the present invention includes Fe, Ni, Fe-Ni alloy, or ferrite having a spinel structure such as Mn-Zn ferrite and Ni-Zn ferrite, and the like.

Iron containing 6.9 wt % of Si was formed on substrates of MgO, ZnO and Zn-Se by sputtering (substrate temperature: about 300° C.) and Fe-Si thin films having (100), (110) and (111) orientation, respectively were obtained.

As a result of measurement of coercive force of the respective specimens thus fabricated, both the specimens having a (100) orientation film and a (110) orientation film had a coercive force of about 4 Oe, but the specimen having a (111) orientation film had a coercive force reduced to 2 Oe which was a half of that of the above two specimens, and thus a magnetic film of high magnetic permeability was obtained.

FIG. 1 is a diagram showing an X-ray diffraction pattern of the Fe-Si thin magnetic film having the (111) orientation formed on the Zn-Se film, as described above. As shown in FIG. 1, diffraction peaks corresponding to the crystal faces (211) and (222) are observed and it was found that there is a tendency that as the diffraction intensity of the crystal face (222) is increased, coercive force is made smaller.

The rate of the change [Sl/l] of the linear dimension in the crystallographic planes (100), (110) and (111) of a single crystal due to magnetostriction is expressed as follows:

(100) plane:

(100) plane:

$$\delta l/l = 3a + (3\lambda_{100}\cos^2\chi/2) + (-\lambda_{100} + \lambda_{111}) \cos(\theta + \chi)\sin(\theta + \chi)\cos\theta\sin\theta, \quad 1$$

(110) plane:

$$\delta l/l = 3a + (3\lambda_{100}\cos^2\chi/2) + (-\lambda_{100} + \lambda_{111}) \cos^2\chi(\sin^4\theta/4 + \mathrm{Sin}^2\theta\cos^2\theta) - 3\sin^2\chi\sin^2\theta\cos^2\theta/4 + \sin\chi\cos\chi(\sin^3\theta\cos\theta/2 - \sin\theta\cos^3\theta), \quad 2$$

(111) plane:

$$\delta l/l = 3a + (\lambda_{100} = \lambda_{111})/12 + (3\lambda_{100} + 6\lambda_{111})/6 \times \cos^2\chi. \quad 3$$

In the above equations, $\theta$ represents an angle between a particular crystallographic axis and a direction in which elongation is measured, $\chi$ represents an angle between magnetization and the direction in which elongation is measured, $\theta+\chi$ represents an angle between the particular crystallographic axis and the magnetization, $\lambda_{100}$ represents a magnetostriction coefficient in <100> direction, $\lambda_{110}$ represents a magnetostriction coefficient in <110> direction, and $\lambda_{111}$ represents a magnetostriction coefficient in <111> direction.

Further, saturation magnetostriction ($\lambda s$) of a polycrystalline film of each specimen mentioned earlier is shown as follows:

(100) oriented film:

$$\lambda s=(\lambda_{100}+\lambda_{111})/2, \quad 4$$

(110) oriented film:

$$\lambda s=(3\lambda_{100}+5\lambda_{111})/8, \quad 5$$

(111) oriented film:

$$\lambda s=(3\lambda_{100}+6\lambda_{111})/9. \quad 6$$

As apparent from these equations, since functional terms with respect to both $\theta$ and $\chi$ exist in the equations in the case of the (100) oriented film (Equation 1) and the (110) oriented film (Equation 2), when the magnetization is directed in one direction in the specimen, each crystallite in the film tends to elongate or contract in a different direction or by a different amount from each other depending upon the direction of a crystallographic axis of each crystallite. On the other hand, in the case of the (111) oriented film (Equation 3), the direction and amount of elongation and contraction are determined only by the magnetizing directions $\chi$ in respective crystals, and thus when magnetizing directions coincide each other, the respective crystals simultaneously elongate and contract by the same amount. Therefore, the (111) orientation film has an isotropic magnetostriction property regardless of magnetizing direction.

From the above-mentioned, it is found that in the (100) oriented film and the (110) oriented film, even if a saturation magnetostriction ($\lambda s$) is zero, a difference in elongation and contraction is caused in each crystallite when a magnetizing direction changes, whereas in the (111) oriented film, a difference of elongation and contraction is not caused in each crystallite, that is, it is found to be isotropic with respect to magnetostriction.

Further, in this case, assuming that $\lambda s$ is $\sim 0$, magnetostriction is not changed at all by the change of magnetizing direction, which is preferable to obtain a thin soft magnetic film.

Further, a magnetic anisotropic energy Ea of a single crystalline specimen in a particular face thereof is expressed as follows. (100) plane:

$$Ea=-(K_1 \cos 4\ o)/8+\mathrm{const.} \quad 7$$

specifically in the case of iron;

$$-K_1/8=5.9\times 10^4$$

(110) plane:

$$Ea = (-K_1/8 + K_2/128)\cos 2\ o + (-3K_1/32 - K_2/64\cos 4\ o + \mathrm{const.} \quad 8$$

specifically in the case of iron;

$$-K_1/8+K_2/128=-5.9\times 10^4$$

$$-3K_1/32-K_2/64=-4.4\times 10^4$$

(111) plane:

$$Ea=K_2 \cos 6\ \phi/128+\mathrm{const.} \quad 9$$

specifically in the case of iron;

$$K_2/128=-69$$

In the above equations, $\phi$ means the above $(\theta+\chi)$ which is an angle between a particular crystallographic axis and magnetization.

As apparent from Equations 7 to 9, the (111) oriented film has a magnetic anisotropic energy which is approximately one-hundredth of that of the other (110) oriented film and (110) oriented film. Therefore, a superior thin soft magnetic film can be obtained from a (111) oriented Fe-Si film $\lambda s$ of which is negligible.

Figure 2:
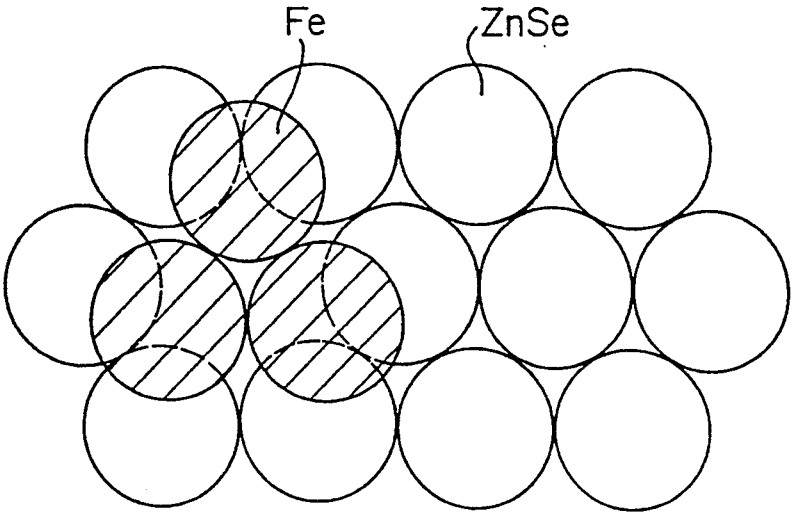
FIG. 2 is a schematic diagram showing the arrangement of crystals when a Fe-Si thin soft magnetic film is formed on a Zn-Se underlayer.

FIG. 2 is a schematic diagram showing the arrangement of crystallite obtained by sputtering a Zn-Se film (zinc sulfide structure of cubic symmetry fcc, a=5.65 Å) on a glass substrate and further sputtering iron (bcc, a=2.87 Å) thereon.

As apparent from FIG. 2, both of Zn-Se and Fe has substantially the same lattice constant. Therefore, Fe is grown on the crystals of Zn-Se heteroepitaxially, and thus it is easy to get (111) orientation.

In this example, Fe was used as a soft magnetic material and a Zn-Se film was used as an underlayer. For Fe, however, an underlayer of a crystallographic structure of fcc the lattice constant a of which is nearly equal to 5.72 (2.86×2=5.72) can be used and the following materials are included therein.

| Material | a |
|---|---|
| Cd—S compound | 5.82 |
| Cu—Br compound | 5.68 |
| Mn—Se compound | 5.82 |
| Hg—S compound | 5.84 |
| Al—As compound | 5.62 |
| Ga—As compound | 5.64 |

Figure 3:
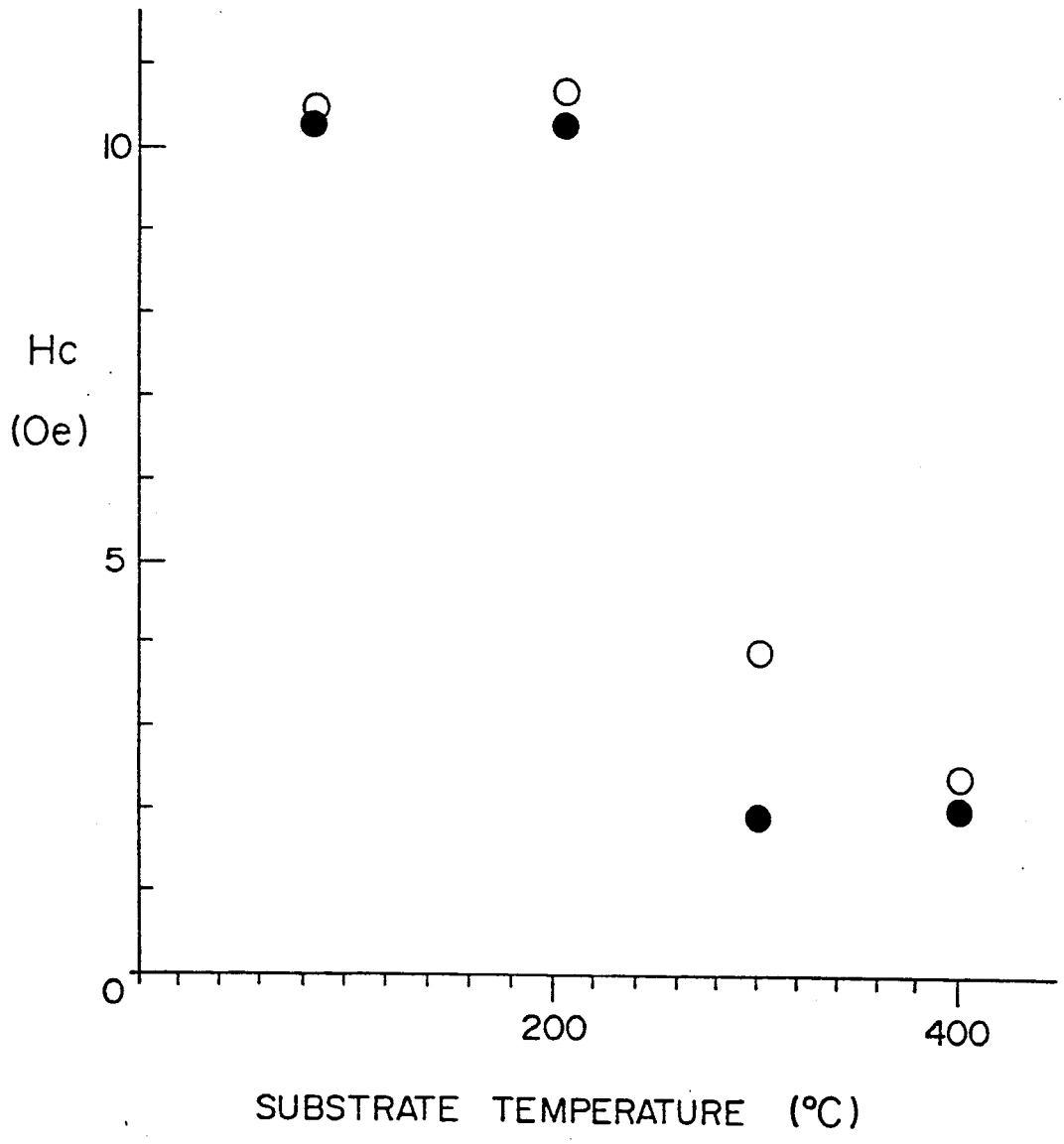
FIG. 3 is a characteristic diagram of coercive force of a thin soft magnetic film obtained by an embodiment of the present invention.

FIG. 3 shows the results of the measurement of coercive force (Hc), when a Zn-Se underlayer of 100 Å thick was formed on glass substrates (by high speed sputtering, film forming speed: 60–80 Å) and iron containing 6.9 wt % of silicon was further formed thereon to a thickness of 960 Å and the glass substrates were kept at 100° C., 200° C., 300° C., and 400° C., respectively. In FIG. 3, marks show coercive force (Hc ) measured in a direction parallel to that of the in-plane magnetic field applied during sputtering and marks show coercive force (Hc ⊥) measured in the direction perpendicular thereto.

According to the experiment effected by the inventors, when a Fe-Si film was directly formed on the same glass substrate as that used in the above test which was heated to 100° C., Hc was 19.1 Oe and Hc ⊥ was 16.2 Oe. On the other hand, the samples prepared according to the present invention in which a film was formed at 100° C. and 200° C. had a Hc and Hc ⊥ of about 10 Oe, exhibiting an about 50% reduction in Hc and an about 38% reduction in Hc ⊥ and thus the specimens had high magnetic permeability.

Further, when the substrate was heated to 300° C. or more, the coercive force thereof was lowered to about 3 Oe, exhibiting a 84% reduction as compared with the above specimen having a Hc of 19.1 Oe and a 82% reduction as compared with the above specimen having Hc ⊥ of 16.2 Oe, and thus a thin soft magnetic film having much higher magnetic permeability was obtained.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A thin soft magnetic film of high magnetic permeability exhibiting isotropic magnetostriction which comprises a thin film of magnetic material of cubic crystallographic symmetry, formed on an underlayer with corresponding crystallographic symmetry to the magnetic material, the plane (111) of the thin film of magnetic material being oriented substantially in parallel to the surface of the thin film.

2. The thin soft magnetic film according to claim 1, wherein said magnetic material of cubic crystallographic symmetry is composed of iron containing silicon and said underlayer is composed of a material selected from the group consisting of Zn-Se compound, Cd-S compound, Cu-Br compound, Mn-Se compound, Hg-S compound, Al-As compound, and Ga-As compound.

3. The thin soft magnetic film according to claim 1, wherein, when a magnetostriction coefficient in the <100> direction of said magnetic material of cubic crystallographic symmetry is $\lambda_{100}$ and a magnetostriction coefficient in the <111> direction of said magnetic material of cubic crystallographic symmetry is $\lambda_{111}$, the following relationship exists:

$$|\lambda_{100}+2\lambda_{111}|<2/3\{|\lambda_{100}|+2|\lambda_{111}|\}.$$

4. The thin soft magnetic film according to claim 1, wherein, when a magnetostriction coefficient in the <100> direction of said magnetic material of cubic crystallographic symmetry is $\lambda_{100}$ and a magnetostriction coefficient in the <111> direction of said magnetic material of cubic crystallographic symmetry is $\lambda_{111}$, the following relationship exists:

$$|\lambda_{100}+2\lambda_{111}|<\tfrac{1}{3}\{|\lambda_{100}|+2|\lambda_{111}|\}.$$

5. The method of manufacturing a thin soft magnetic film, which comprises forming a thin film of a magnetic material of cubic crystallographic symmetry on an underlayer corresponding to the magnetic material, both the thin film of a magnetic material and the underlayer having the same lattice constant, while heating the underlayer at 300° C. or higher, thereby making the plane (111) of the thin film of the magnetic material orient substantially in parallel to the surface of the thin film.

6. The method of manufacturing a thin soft magnetic film according to claim 5, wherein said underlayer is composed of a material selected from the group consisting of Zn-Se compound, Cd-S compound, Cu-Br compound, Mn-Se compound, Hg-S compound, Al-As compound, and Ga-As compound and said magnetic material of cubic crystallographic symmetry is composed of iron containing silicon.

* * * * *